United States Patent [19]

van der Meulen

[11] 4,332,578

[45] Jun. 1, 1982

[54] APPARATUS FOR MAKING THERMOPLASTIC CARRIER BAGS

[76] Inventor: Leonard van der Meulen, Immeuble Saadi, Appt. 22A, Ariana, Tunisia

[21] Appl. No.: 179,170

[22] Filed: Aug. 18, 1980

[30] Foreign Application Priority Data

Aug. 21, 1979 [NL] Netherlands ..... 7906324

[51] Int. Cl.[3] ..... B31B 1/16; B31B 1/64; B31B 1/86

[52] U.S. Cl. ..... 493/197; 156/267; 156/443; 156/510; 493/208; 493/234; 493/254; 493/342; 493/926

[58] Field of Search ..... 156/510, 515, 250, 251, 156/583.1, 583.2, 267, 443; 493/193, 195, 196, 197, 200–202, 234, 342, 359, 206, 205, 208, 926, 254, 257

[56] References Cited

U.S. PATENT DOCUMENTS

| | | | |
|---|---|---|---|
| 2,952,299 | 9/1960 | Finke | 156/510 |
| 3,729,361 | 4/1973 | Westlake, Jr. | 156/510 |
| 3,893,884 | 7/1975 | Class | 156/510 |
| 4,065,344 | 12/1977 | Weist | 156/510 |
| 4,114,520 | 9/1978 | Achelpohl et al. | 156/515 |
| 4,115,183 | 9/1978 | Achelpohl et al. | 156/515 |
| 4,198,259 | 4/1980 | van der Meulen | 156/515 |

*Primary Examiner*—Michael G. Wityshyn
*Attorney, Agent, or Firm*—Hume, Clement, Brinks, Willian & Olds, Ltd.

[57] ABSTRACT

An apparatus for making thermoplastic carrier bags (so-called T-shirt bags) comprises means for feeding a continuous tubular strip of thermoplastic film, either side of which comprises a gusset fold, said strip being advanced with a constant velocity to a cylindrical drum the housing of which comprises embedded heatsealing means, said apparatus further comprising a cutting member and a transverse cutting knife co-operating with the strip said member sequentially providing the tubular strip with a U-shape cut upstream of the drum and said cutting knife operating synchronously with the cutting member in co-operation with the drum for transversely cutting through the strip somewhat beyond the legs of said U-shape cut so as to produce strip portions, said drum further comprising folding means for said strip portions.

5 Claims, 2 Drawing Figures

APPARATUS FOR MAKING THERMOPLASTIC CARRIER BAGS

BACKGROUND OF THE INVENTION

1. Field of the Invention

The present invention relates to an apparatus for making carrier bags from a strip of thermoplastic film, an initial continuous flat tubular strip being used, either side of which comprising a gusset fold, said strip via a set of supply rollers, being advanced with a constant velocity to a cylindrical drum which co-operates with a supporting belt, said drum being provided with heat-sealing means embedded in the periphery of the drum according to describing lines, the circumferential velocity of the drum exceeding the feeding velocity of the supply rollers.

2. Description of the Prior Art

In the prior art, apparatus of this type has been used in various embodiments. In one instance a bag is manufactured the open edge of which is reinforced, whereupon said bag is transformed into a carrier bag.

SUMMARY OF THE INVENTION

In view of the foregoing factors and conditions of the prior art, it is a primary object of the present invention to provide an apparatus starting from a structure known perse, which produces a range of ready carrier bags in one single operation, and which delivers these carrier bags already partially folded.

According to the present invention, these objects are attained by the following combination of features:

- a cutting member co-operating with the supply rollers for sequentially providing the strip with a U-shape cut at a mutual distance corresponding to the predetermined length of the carrier bags;
- a cutting knife operating synchronously with said cutting member, cutting off a portion of the strip transversely, somewhat beyond the legs of the U-shape cut;
- at least one folding knife along a describing line of the drum circumference being accommodated in the middle of the cut off strip portion, which folding knife co-operates with folding tongs in an adjacent auxiliary drum.

Due to these features, the apparatus according to the present invention produces in one single operation not only a final product being already folded, and thus easier to be handled, but also permits a change in the size of the carrier bags by changing the ratio of velocity between the supply rollers on the one hand and the drum on the other hand. At a certain supply velocity of the tubular strip, it is possible, by increasing the velocity of the drum and of the cutting member and the cutting knife moving synchronously with said drum, to effect a decrease in the length of the carrier bags. From the foregoing, it follows that the consumer's demands can always be met in this respect.

In a specific embodiment of the present invention both the cutting member and the cutting knife operate at a location in the path of the tubular strip, lying immediately in front of the drum. In order to ensure that the cut-off strip portions are deposited on the periphery of the drum in the right predetermined position, the cutting knife preferably co-operates with a roller, the periphery of which is provided with suction apertures being connected with a source of subatmospheric pressure, along an arcuate path rotating toward the drum.

This causes the leading end of a cut off strip portion to remain fixed, so that this strip portion is deposited exactly on a predetermined point along the periphery of the drum without danger of shifting or getting loose.

The first step for making carrier bags from a strip of thermoplastic tubular film in one single operation, is performed by the cutting member. In a preferred embodiment said cutting member is provided with at least one indentation which forms a point of temporarily attachment for the U-shape cut. Due to this feature, the cut off portion of the tubular strip stays in position during the subsequent steps of the operation.

In a preferred embodiment, the drum co-operates with a drawing member, arranged along the periphery of the drum beyond the supporting belt, but in front of the auxiliary drum, for acting upon the strip portion inside the U-shaped cut. Said drawing member removes the strip portion which has almost been cut loose, as a result of which straps for the carrier bags are realized. The first user of the carrier bag need not manually remove the cut-off flap before employing said carrier bag.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF A PREFERRED EMBODIMENT

In order to best understand the present invention a description of a preferred embodiment thereof is provided accompanied by drawings.

Figure 1:
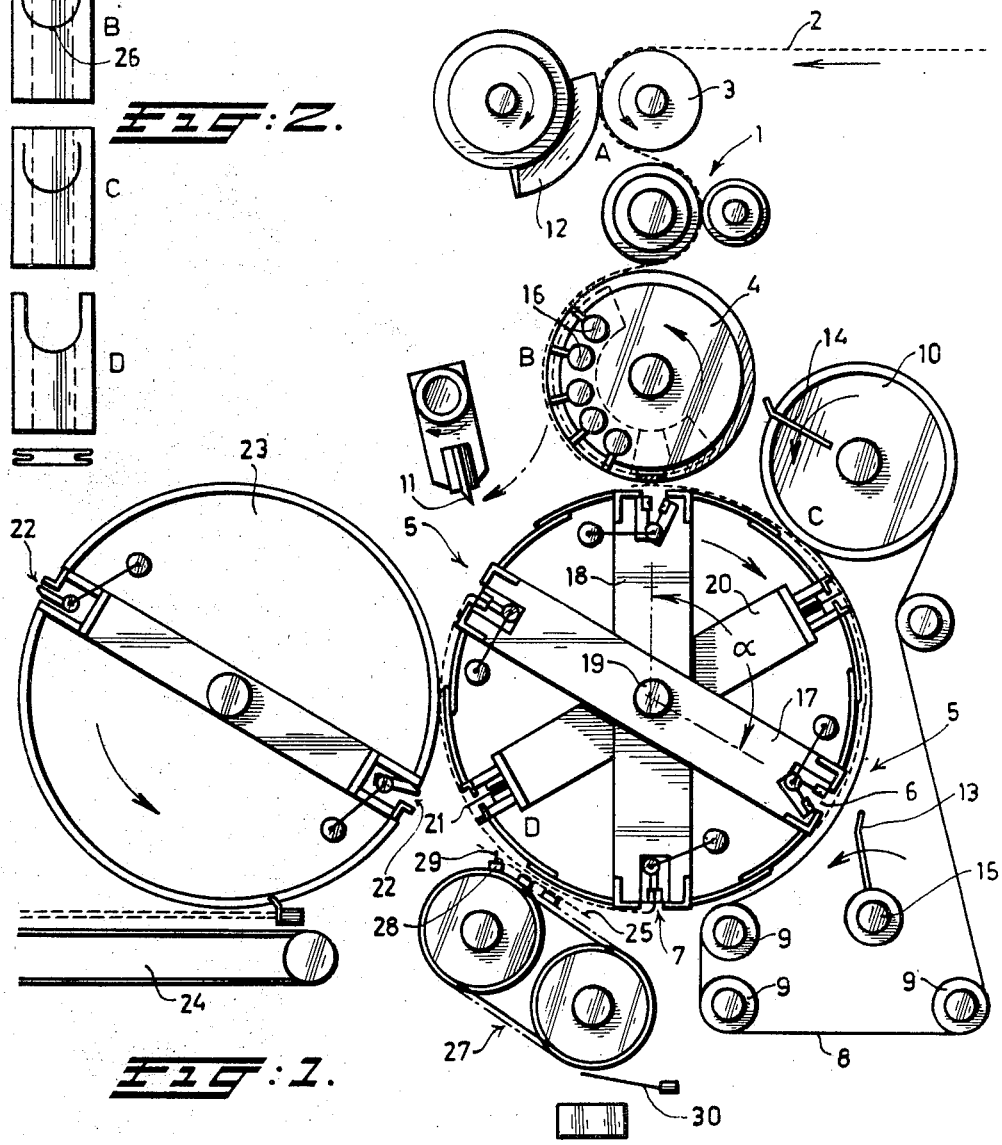
FIG. 1 is a side view of the present machine showing the most important parts.

With a view to apparatus known in the art, only those parts forming the novel subject matter of the present invention, will be described hereinafter. The present apparatus comprises a set of supply rollers 1 for a tubular strip 2 of thermoplastic film, either side of said strip being provided with a gusset fold, in a manner known per se (see FIG. 2). Referring to FIG. 1, a strip 2 is first guided along a supporting roller 3 and, after having passed the supply rollers 1, along an auxiliary drum 4. The apparatus according to the present invention further comprises a cylindrical drum 5 provided with heat-sealing means 6, 7, mounted in a direction according to the describing line of drum 5 and being embedded in the housing of said drum. A supporting belt 8 is slung along part of the periphery of the drum 5 and is further conveyed along smaller rollers 9 and a large roller 10.

The peripheral velocity of the drum 5 is greater than the feeding velocity of the supply rollers 1. The peripheral velocity of the auxiliary drum 4 equals the velocity of the drum 5. The leading edge of the strip 2, arriving from the auxiliary drum 4 upon the drum 5, will have a smaller velocity than said drum 5 so that the circumference of the housing of said drum will slip underneath the strip 2. This slipping phenomenon stops as soon as the front portion of the strip 2 is cut off. To that end a cutting knife 11 co-operates with the auxiliary drum 4. At the moment that the cutting knife 11 cuts off part of strip 2, the leading edge of said cut off strip portion is located exactly above a heatsealing means 6. Henceforth the cut off strip portion will immediately acquire the velocity of the drum, as a braking force is no longer exerted on this strip portion. A further rotation of the drum 5 will now cause the trailing edge of the cut off strip portion to arrive above the heatsealing means 7.

Prior to introducing the strip onto drum 5 a cutting member 12 operates upon said strip 2. This member provides strip 2 with a U-shape cut so coordinated with the action of cutting knife 11 that the latter knife cuts off strip 2 somewhat beyond the legs of said U-shape cut (see FIG. 2). The tangential velocity of the cutting knife 11 equals the velocity of cutting member 12 which runs synchronously with the drum 5. The feeding velocity of the strip of thermoplastic tubular film 2 is determined by the supply rollers 1. This does not lead to any problems as to the action of cutting knife 11; the difference in velocity at the cutting member 12 is canceled by the supporting roller 3 being idle. Consequently the supporting roller 3, during its co-operation with cutting member 12, together with the intermediate tubular strip 2 will temporarily have a higher velocity. However, this will not impair the feeding velocity by which strip 2 is fed to the auxiliary drum 4 and drum 5, as the supply rollers 1 are arranged downstream from the supporting roller 3.

The ends of the cut off strip portion lying upon the periphery of the drum 5, are urged between the jaws of the heatsealing means 6 and 7 by means of some conventional fingers 13, 14, respectively which are arranged on a shaft 15 and on roller 10.

For retaining the tubular strip 2 upon the auxiliary drum 4, a number of suction apertures 16 is provided along the periphery of said drum 4, said apertures being connected with a source of sub-atmospheric pressure (not shown) along the arcuate path rotating toward drum 5. In this manner, the strip 2 is retained upon the periphery of the auxiliary drum 4, thus preventing any undesired displacements (shifting) of the leading edge of the still uncut strip. This provision is known per se.

The heatsealing means 6, 7 is arranged upon the extremities of two diametrically extending supports 17, 18. These supports are rotatable around a common shaft 19 in order to adjust the length of the carrier bag to be manufactured, a feature which will still be described hereinafter. On shaft 19 a third support 20 is accomodated carrying on both ends a conventional folding knife 21. Said third support 20 is located along the bisectrix of the angle $\alpha$ between the two supports 17, 18. The two folding knives 21 are directed along a describing line of the drum 5, and co-operate with folding tongs 22 disposed in an adjacent auxiliary drum 23. In this manner, the heatsealed strip portions can be taken over from the drum 5 by the auxiliary drum 23, thereby folding said strip portions. In this folded condition, the strip portions (the carrier bags) are deposited on a collecting apparatus 24 (not to be described further).

Figure 2:
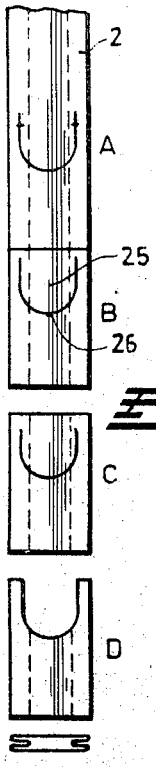
FIG. 2 is a view of the various steps to which the thermoplastic tubular strip is submitted.

Referring now to FIG. 2 the steps of making the carrier bags from a tubular strip of thermoplastic film are as follows.

During step A member 12 has made a U-shape cut 25 in the strip 2. In this respect, it is observed that said cutting member 12 at least comprises one indentation causing a place 26 of temporarily attachment, so that the cut-off flap of the strip 2 will not move for the time being.

During step B a strip portion is transversely cut off at a point beyond the legs of the U-shape cut 25. As a result said U-shape cut-off flap is still connected with the strip in at least three points.

During step C the cut-off strip portion has come apart from the fed tubular strip, due to the increased velocity of the drum 5. During step D a drawing member 27 will become operative. This member is located along the periphery of drum 5 on a location just beyond the supporting belt 8 and still upstream of the auxiliary drum 23. The drawing member 27 consists of two chains provided with some cross beams 28 on to which pins 29 are fastened which engage in the round front side of the flap, obtained by the U-shape cut 25. In this manner, said flap is torn loose to produce the final product as shown at D in FIG. 2, and subsequently pulled off from pins 29 via a fork 30.

It is observed that, instead of two supports 17, 18, the apparatus according to the invention may also comprise four or more of these supports dependent upon the diameter of the drum 5 and the length of the strip portions required for the carrier bags to be made. On the other hand, only one end of each support 17 and 18 may be provided with heatsealing means 6 and 7.

A change in the size (i.e. the length) of the carrier bags to be made causes a reduction or increase of the angle $\alpha$ between the supports 17 and 18. Support 20 will then remain positioned on the bisectrix of this angle. A reduction of angle $\alpha$ means that the carrier bags become shorter which, at a constant feeding velocity of the rollers 1 also implies that the rotational velocity of the drum 5 should be increased accordingly. Synchronously therewith, the rotational velocity of the cutting knife 11 and of cutting member 12 is increased too. Both the supporting belt 8 and the fingers 13, 14 will automatically acquire an identical increase in velocity. Assuming that the reduction of the angle $\alpha$ is effected by a rotation of support 17 with the heatsealing means 6 a corresponding adaptation of the angular phase of both the cutting knife 11 and the finger 13 will have to be carried out. For said cutting knife 11 is operative at the moment that the leading edge of the strip 2 is located above one of the heatsealing means 6. The finger 13 also co-operates with said heatsealing means.

The advantages of the apparatus according to the present invention can be summarized as follows:

The desired carrier bags are made in one single operation, the U-shape cut required for providing a "T-shirt bag" being made prior to the heatsealing operation, the tubular strip portions being cut off at a point located immediately before the heatsealing drum.

Various different numbers of the carrier bags can be made by one apparatus, after some adaptations to its implements which is an important factor for a manufacturer of carrier bags.

The carrier bags are delivered in folded condition, if desired in packages, which simplifies their handling and also reduces the outer size of final products to be delivered.

What is claimed is:

1. Apparatus for making carrier bags of thermoplastic material starting from a continuous tubular strip of thermoplastic film, either side of which contains a gusset fold, said apparatus comprising a set of supply rollers, said supply rollers driven at a constant speed for advancing said strip to a cylindrical drum and a co-operating supporting belt, said drum being provided with heatsealing means mounted in the periphery of the drum housing and means for rotating said drum with a circumferential velocity exceeding the feeding speed of the supply rollers, said apparatus further comprising:

a. cutting means co-operating with the supply rollers for sequentially providing the tubular strip of thermoplastic film with a U-shape cut at spaced locations corresponding to the length of the carrier bags desired;

b. severing means for cutting off the strip transversely at a line, somewhat beyond the legs of the U-shape cut so as to obtain cut-off strip portions;

c. heat sealing means on the periphery of said drum for sealing the ends of said cut-off strip portions, and means for urging the ends of the cut-off strip portions into operative sealing arrangement with said heatsealing means;

d. folding means along a describing line of the drum circumference, being positioned substantially half way of the length of the cut-off strip portion, and arranged for cooperation with folding tongs in an adjacent auxiliary drum for folding the cut-off strip portions.

2. An apparatus according to claim 1, wherein said severing means co-operates with an auxiliary drum the periphery of which is provided with suction aperatures which are connected with a source of sub-atmospheric pressure for holding said cut-off strip portions.

3. An apparatus according to claim 1, wherein said cutting means is provided with at least one indentation for providing an interruption in the U-shape cut for providing a temporary retaining piece.

4. An apparatus according to claim 1, wherein said drum co-operates with a drawing member arranged along the periphery of the drum beyond the supporting belt but before the auxiliary drum for co-operating with and removing the strip material inside the U-shape cut.

5. An apparatus according to claim 1, wherein said drum is provided with three support means running diametrically, the ends of two of which being means for supporting said heatsealing means, and said third support means for supporting said folding means, said third support means located substantially along the bisectrix of the angle between said first two support means.

* * * * *